US012497232B2

(12) United States Patent
Yang et al.

(10) Patent No.: US 12,497,232 B2
(45) Date of Patent: Dec. 16, 2025

(54) PASTE CONTAINER

(71) Applicant: SHYA HSIN PACKAGING INDUSTRY (CHINA) CO., LTD., Kunshan (CN)

(72) Inventors: Cuihong Yang, Kunshan (CN); Ming Lyu, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 18/963,819

(22) Filed: Nov. 29, 2024

(65) Prior Publication Data

US 2025/0304360 A1 Oct. 2, 2025

(30) Foreign Application Priority Data

Mar. 29, 2024 (CN) ..... 202410382341.3

(51) Int. Cl.

| | |
|---|---|
| ***B65D 83/762*** | (2025.01) |
| ***A45D 40/04*** | (2006.01) |
| ***A45D 40/26*** | (2006.01) |
| ***B65D 83/761*** | (2025.01) |
| *A45D 40/00* | (2006.01) |

(52) U.S. Cl.

CPC ..... *B65D 83/762* (2025.01); *A45D 40/04* (2013.01); *A45D 40/26* (2013.01); *B65D 83/761* (2025.01); *A45D 2040/0025* (2013.01)

(58) Field of Classification Search

CPC ..... A45D 40/04; A45D 2040/0025; B65D 83/761

USPC ..... 401/75, 175

See application file for complete search history.

(56) References Cited

U.S. PATENT DOCUMENTS

| | | | | |
|---|---|---|---|---|
| 7,213,994 | B2 * | 5/2007 | Phipps | A61M 35/003 222/391 |
| 7,309,184 | B2 * | 12/2007 | Butcher | A45D 40/262 401/172 |
| 10,427,859 | B2 * | 10/2019 | Bilton | B65D 83/766 |
| 10,687,602 | B2 * | 6/2020 | Thulin | A45D 40/04 |

(Continued)

FOREIGN PATENT DOCUMENTS

| | | | |
|---|---|---|---|
| BR | 8805360 | A | 6/1989 |
| CN | 201870004 | U | 6/2011 |

(Continued)

*Primary Examiner* — Jennifer C Chiang

(74) *Attorney, Agent, or Firm* — Bayramoglu Law Offices LLC

(57) ABSTRACT

A paste container includes a lid, an inner bottle, a stopper, a threaded rod, a pedestal, and an inner lid fixed at a top of the inner bottle, where a bottom of the lid is detachably connected to the pedestal; the stopper is provided in the inner bottle and circumferentially fixed with the inner bottle; the threaded rod includes a bottom circumferentially fixed with the pedestal, and a top extending into a first through hole at a bottom of the inner bottle and threadedly connected to the stopper; the pedestal is sleeved on the bottom of the inner bottle and rotatably connected to the inner bottle; the pedestal is capable of rotating unidirectionally relative to the inner bottle in a step-by-step manner; a top of the stopper is capable of supporting a paste; and the threaded rod rotates with rotation of the pedestal and drives the stopper.

9 Claims, 16 Drawing Sheets

(56) References Cited

U.S. PATENT DOCUMENTS

| | | | |
|---|---|---|---|
| 2005/0105956 | A1 | 5/2005 | Gutberlet et al. |
| 2020/0054110 | A1 | 2/2020 | Wiesenthal et al. |
| 2021/0137243 | A1 | 5/2021 | Nolan et al. |

FOREIGN PATENT DOCUMENTS

| | | | |
|---|---|---|---|
| CN | 205076275 | U | 3/2016 |
| CN | 215685463 | U | 2/2022 |
| CN | 216019642 | U | 3/2022 |
| CN | 115886421 | A | 4/2023 |
| CN | 117068575 | A | 11/2023 |
| CN | 222054850 | U | 11/2024 |
| JP | 3249649 | U | 12/2024 |
| WO | 2020227722 | A1 | 11/2020 |

* cited by examiner

PASTE CONTAINER

CROSS-REFERENCE TO THE RELATED APPLICATIONS

This application is based upon and claims priority to Chinese Patent Application No. 202410382341.3, filed on Mar. 29, 2024, the entire contents of which are incorporated herein by reference.

TECHNICAL FIELD

The present disclosure relates to containers and in particular to a paste container.

BACKGROUND

For existing cosmetic containers, by rotating the pedestal, the threaded rod rotates and drives the nut to move up and down for discharge. However, in the case of a small amount of the remaining cosmetics in use, users need to rotate the pedestal repeatedly to discharge the material, which is inconvenient. Alternatively, when the pedestal is rotated, users cannot master a rotation angle effectively, so it is hard to accurately adjust an extended length of the paste, which causes a waste of the paste.

SUMMARY

In order to overcome the above defects, the present disclosure provides a paste container. The paste container is used conveniently, and can accurately control the extended length of the paste.

To solve the technical problems, the present disclosure adopts the following technical solutions: The present disclosure provides a paste container, including a lid, an inner bottle, a stopper, a threaded rod, a pedestal, and an inner lid fixed at a top of the inner bottle, where a bottom of the lid is detachably connected to the pedestal; the stopper is provided in the inner bottle and circumferentially fixed with the inner bottle; the threaded rod includes a bottom circumferentially fixed with the pedestal, and a top extending into a first through hole at a bottom of the inner bottle and threadedly connected to the stopper; the pedestal is sleeved on the bottom of the inner bottle and rotatably connected to the inner bottle; the pedestal is capable of rotating unidirectionally relative to the inner bottle in a step-by-step manner; a top of the stopper is capable of supporting a paste; and the threaded rod rotates with rotation of the pedestal and drives the stopper to move toward the top of the inner bottle, thereby squeezing the paste out of a discharge hole at a top of the inner lid.

Optionally, a circle of ratchets are provided on an inner wall of the pedestal at intervals; an elastic piece is provided at the bottom of the inner bottle; and by rotating the pedestal, an end of the elastic piece is capable of being unidirectionally clamped into gaps between the ratchets in sequence.

Optionally, the ratchets are equidistantly distributed on the inner wall of the pedestal.

Optionally, a plurality of first rotation stop strips are provided at a middle of an outer wall of the inner bottle; and a circle of first convex strip capable of cooperating with the first rotation stop strips is provided on an inner wall of the inner lid.

Optionally, the threaded rod includes a rod portion; the rod portion extends along a radial direction of the rod portion to form a base having two steps; the rod portion cooperates with the stopper; the base of the threaded rod is located in the pedestal; at least two second rotation stop strips are circumferentially provided on a sidewall of the base; an inner wall of a bottom of the pedestal protrudes inward along a radial direction of the pedestal to form at least one second convex strip; and the second convex strip is located between two adjacent ones of the second rotation stop strips.

Optionally, a circle of fixing hook is further provided on the sidewall of the base; and a fixing groove capable of cooperating with the fixing hook is formed in an inner wall of the pedestal.

Optionally, an outer wall of the stopper is tightly attached to an inner wall of the inner bottle; a plurality of third rotation stop strips are provided on the inner wall of the inner bottle; and a groove capable of cooperating with the third rotation stop strips is formed in the outer wall of the stopper.

Optionally, the stopper includes a nut, an inner ring, and a carrier; the nut and the carrier are respectively buckled at two sides of the inner ring; a threaded hole is formed in a middle of the nut; a fixed seat is provided convexly at a middle of the inner ring; a second through hole for allowing the threaded rod to penetrate is formed in a middle of the fixed seat; a third through hole for allowing the fixed seat to penetrate is formed in a middle of the carrier; the paste is provided at a top of the carrier; and the threaded rod penetrates through the paste.

Optionally, two opposite planes are provided on the threaded rod; third convex strips extending along an axial direction of the threaded rod are provided oppositely on the two planes; avoidance grooves for allowing two third convex strips to pass through are respectively formed at two sides of the second through hole; and the nut is relatively static with the inner ring and the carrier.

Optionally, a circle of positioning protrusion is provided on an outer wall of the inner bottle; and a circle of positioning groove capable of rotatably cooperating with the positioning protrusion is formed in an inner wall of the pedestal.

The present disclosure has the following beneficial technical effects: The paste container includes the lid, the inner bottle, the stopper, the threaded rod, and the pedestal. In use, the pedestal is rotated. Since the pedestal can only rotate unidirectionally relative to the inner bottle in a step-by-step manner, only a corresponding number of steps is rotated as required when the paste is used, thereby controlling a length of the paste extending out of the inner bottle. Not only is the operation convenient, but also the extended length of the paste can be controlled accurately. The present disclosure is used conveniently, and can accurately control the extended length of the paste.

Figure 1:
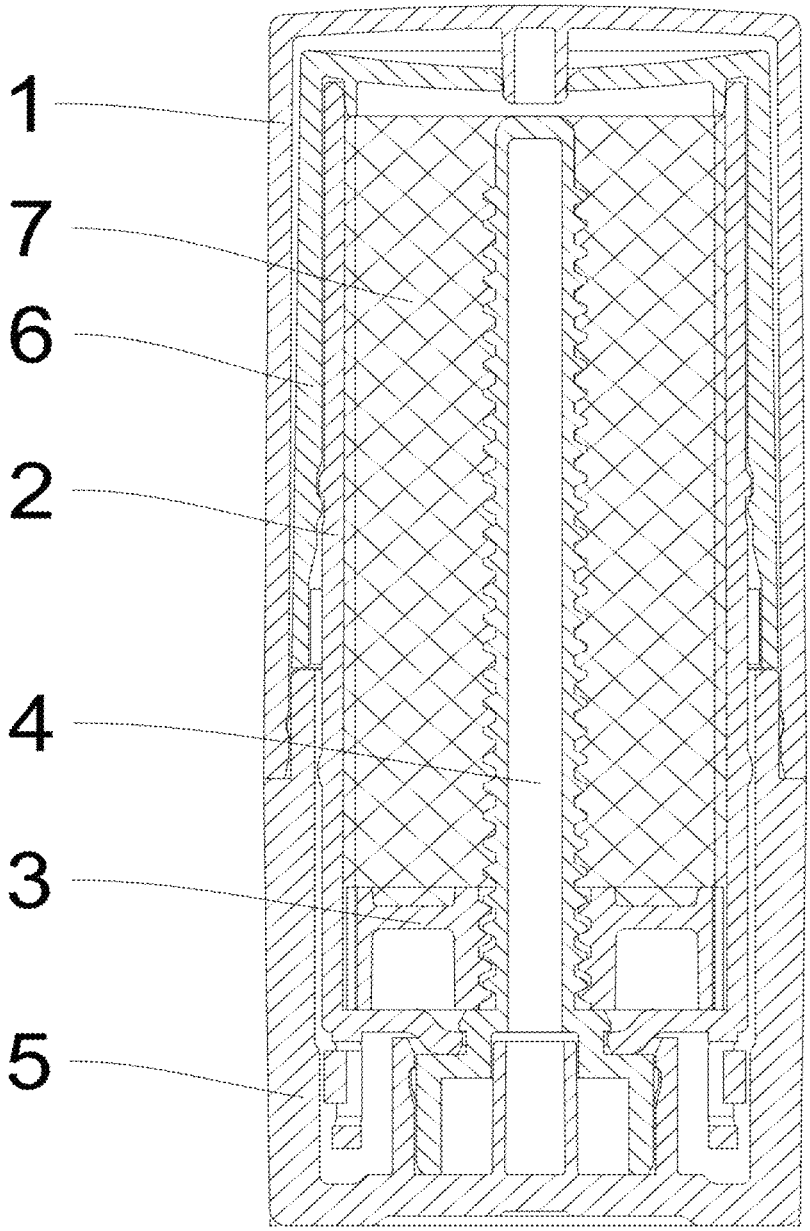
FIG. 1 is a sectional view of a complete machine according to the present disclosure.
Figure 2:
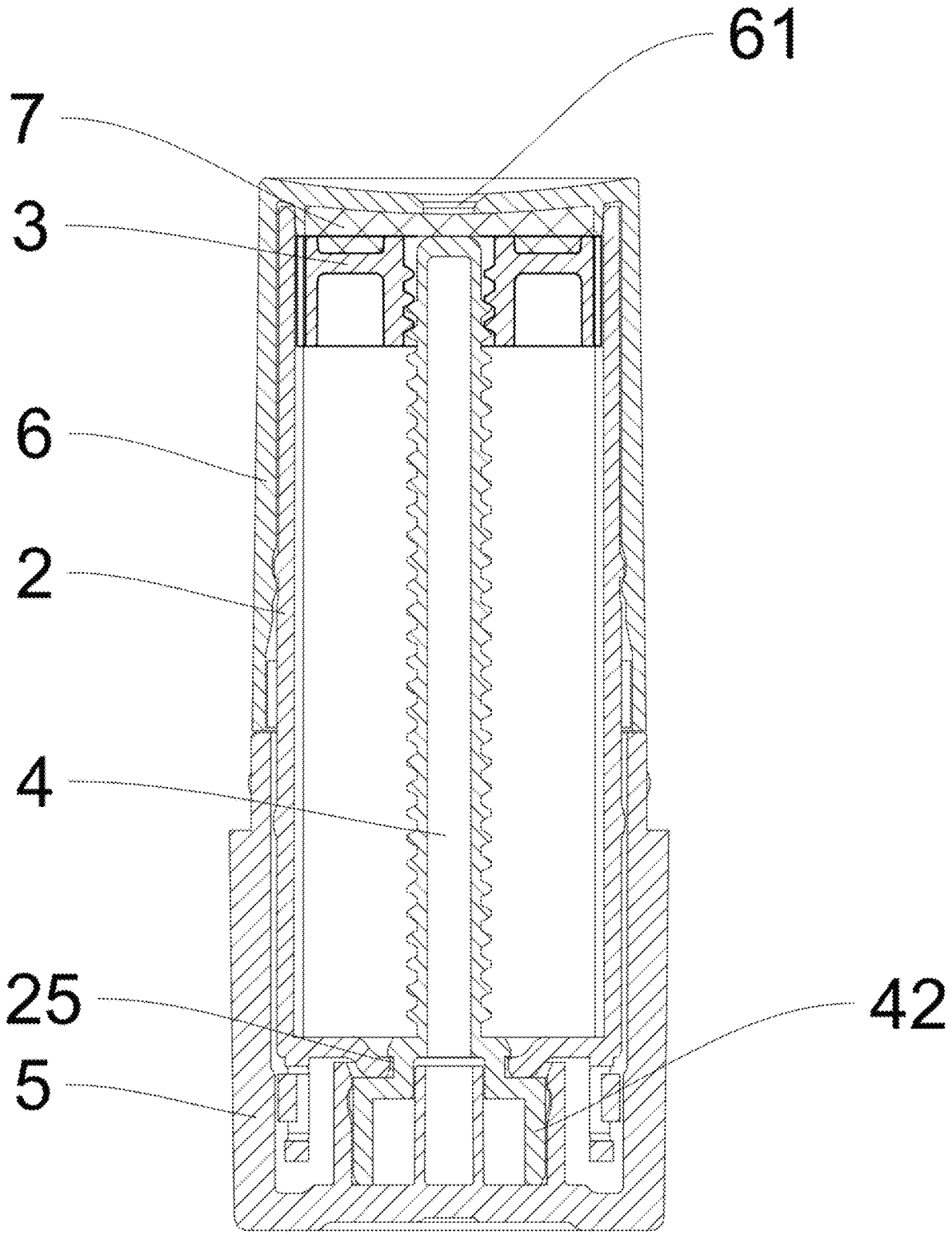
FIG. 2 is a sectional view of a complete machine without a lid according to the present disclosure.

1: lid, 2: inner bottle, 21: first rotation stop strip, 22: positioning protrusion, 23: elastic piece, 24: third rotation stop strip, 25: first through hole, 3: stopper, 31: nut, 32: inner ring, 33: carrier, 34: groove, 35: avoidance groove, 36: fixed seat, 4: threaded rod, 41: rod portion, 42: base, 43: second rotation stop strip, 44: fixing hook, 45: plane, 46: third convex strip, 47: step, 5: pedestal, 51: ratchet, 52: second convex strip, 53: fixing groove, 6: inner lid, 61: discharge hole, 62: first convex strip, and 7: paste.

DETAILED DESCRIPTION OF THE EMBODIMENTS

In order to understand the technical means of the present disclosure more clearly and implement the technical means according to contents in the specification, specific implementations of the present disclosure will be further described below in detail with reference to the accompanying drawings and embodiments. The embodiments described below are intended to illustrate the present disclosure, rather than limit the scope of the present disclosure.

A specific embodiment provides a paste container of the present disclosure in detail. As shown in FIGS. 1-15, the paste container includes lid 1, inner bottle 2, stopper 3, threaded rod 4, pedestal 5, and inner lid 6 fixed at a top of the inner bottle 2. A bottom of the lid 1 is detachably connected to the pedestal 5. The stopper 3 is provided in the inner bottle 2 and circumferentially fixed with the inner bottle 2. The threaded rod 4 includes a bottom circumferentially fixed with the pedestal 5, and a top extending into a first through hole 25 at a bottom of the inner bottle 2 and threadedly connected to the stopper 3. The pedestal 5 is sleeved on the bottom of the inner bottle 2 and rotatably connected to the inner bottle 2. The pedestal 5 can rotate unidirectionally relative to the inner bottle 2 in a step-by-step manner. A top of the stopper 3 can support paste 7. The threaded rod 4 rotates with rotation of the pedestal 5 and drives the stopper 3 to move toward the top of the inner bottle 2, thereby squeezing the paste 7 out of discharge hole 61 at a top of the inner lid 6. In use, the pedestal 5 is rotated. Since the pedestal 5 can only rotate unidirectionally relative to the inner bottle 2 in a step-by-step manner, only a corresponding number of steps is rotated as required when the paste 7 is used, thereby controlling a discharge amount of the paste 7. Not only is the operation conveniently, but also the discharge amount of the paste 7 can be controlled as required. The present disclosure is used conveniently, and can accurately control the discharge amount of the paste 7.

Figure 6:
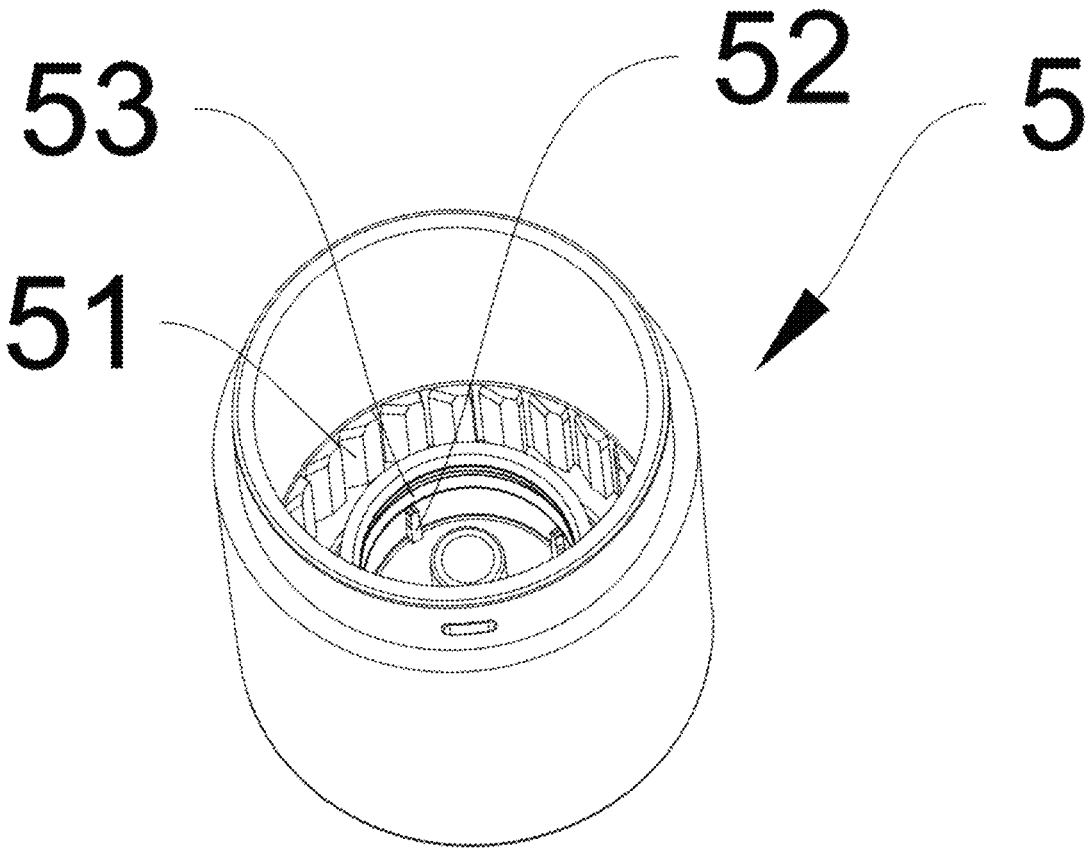
FIG. 6 is a perspective view of a pedestal according to the present disclosure.
Figure 7:
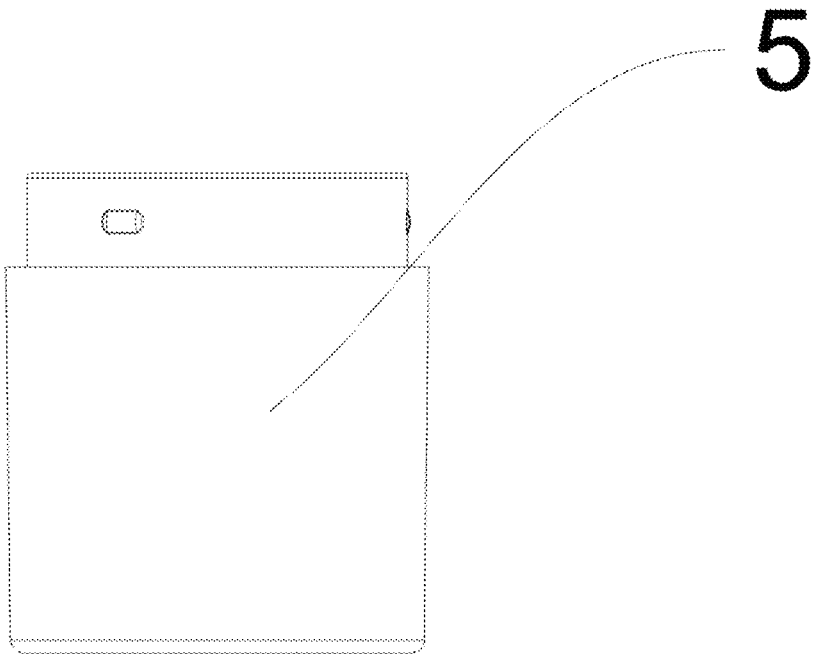
FIG. 7 is a front view of a pedestal according to the present disclosure.
Figure 8:
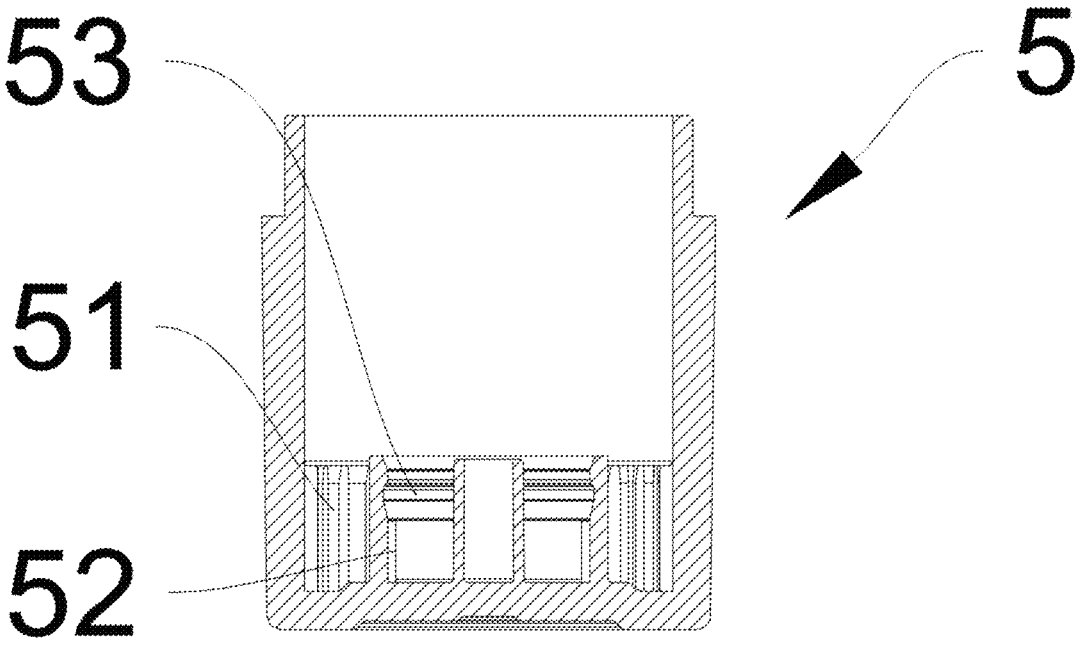
FIG. 8 is a sectional view of a pedestal according to the present disclosure.
Figure 9:
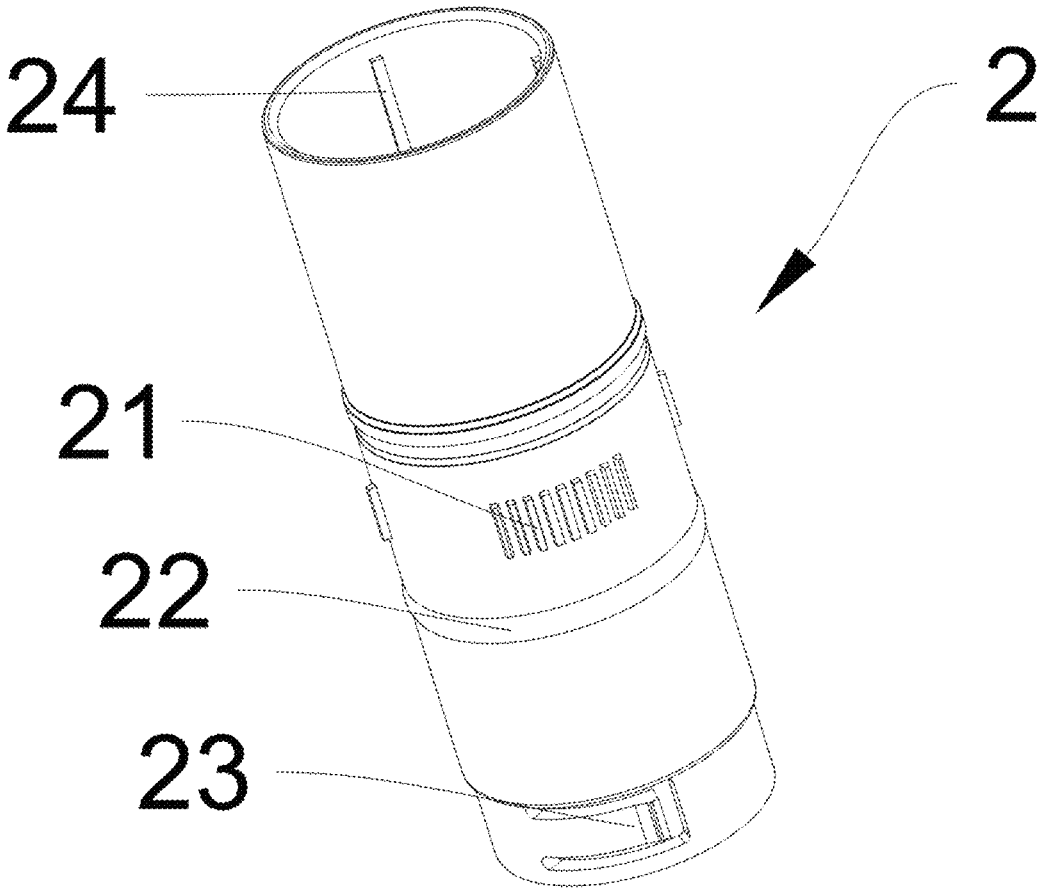
FIG. 9 is a perspective view of an inner bottle according to the present disclosure.

Referring to FIG. 6 and FIG. 9, in the embodiment, optionally, a circle of ratchets 51 are provided on an inner wall of the pedestal 5 at intervals. Elastic piece 23 is provided at the bottom of the inner bottle 2. Specifically, the elastic piece 23 is provided on a sidewall of the bottom of the inner bottle 2. By rotating the pedestal 5, an end of the elastic piece 23 can be unidirectionally clamped into gaps between the ratchets 51 in sequence. By clamping the end of the elastic piece 23 into the gaps between the ratchets 51 in sequence, the pedestal 5 rotates unidirectionally relative to the inner bottle 2 in the step-by-step manner.

Referring to FIG. 6, in the embodiment, optionally, the ratchets 51 are equidistantly distributed on the inner wall of the pedestal 5, so as to ensure a same angle in each step-by-step rotation.

Figure 3:
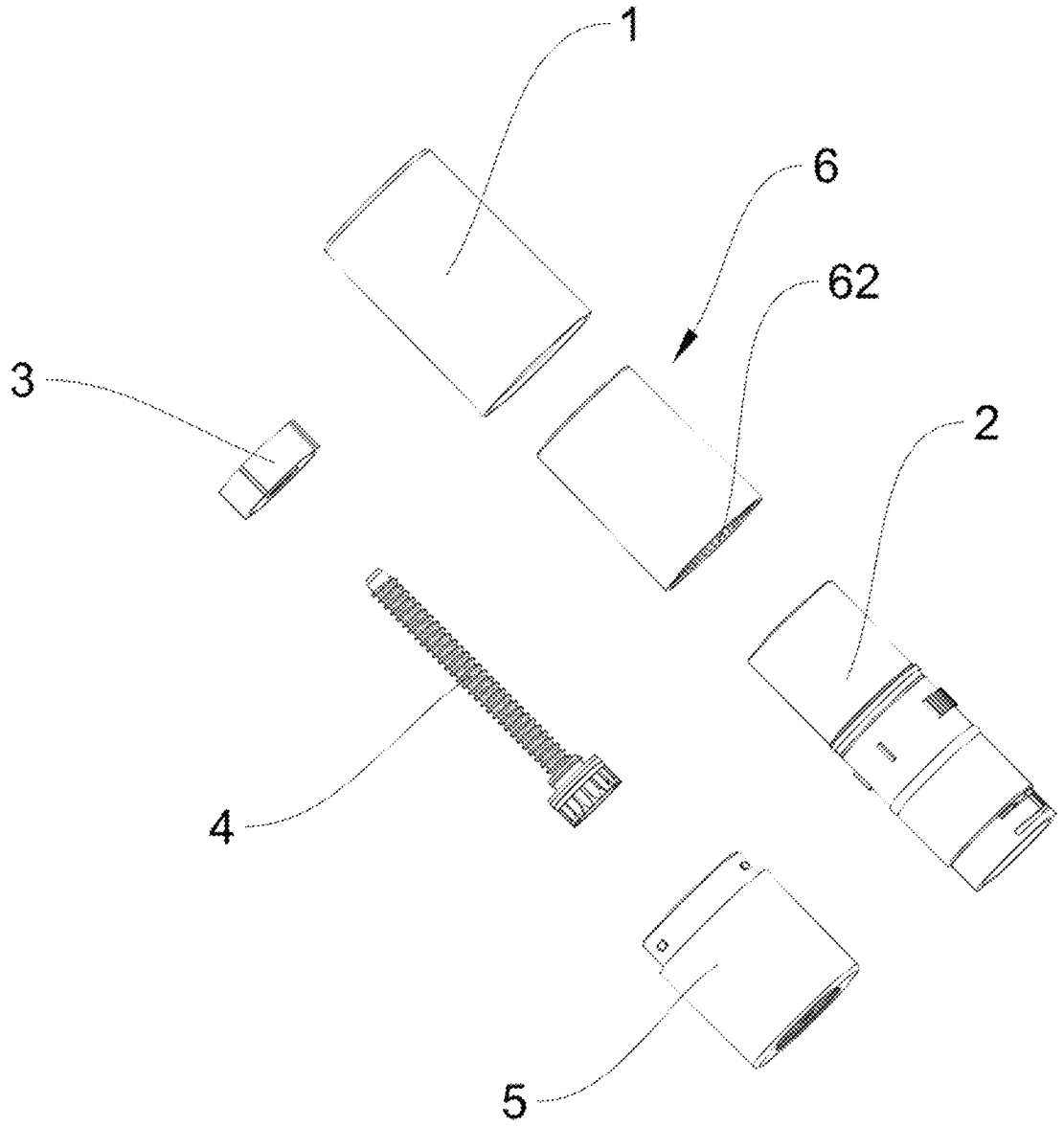
FIG. 3 is a perspective exploded view of a complete machine according to the present disclosure.
Figure 4:
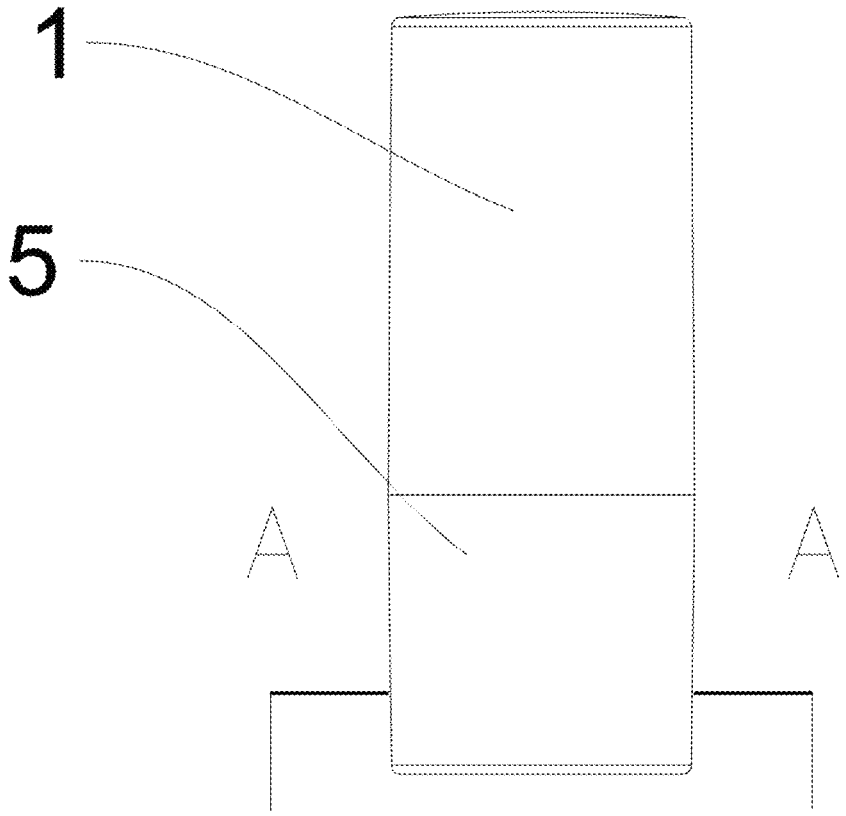
FIG. 4 is a front view of a complete machine according to the present disclosure.
Figure 5:
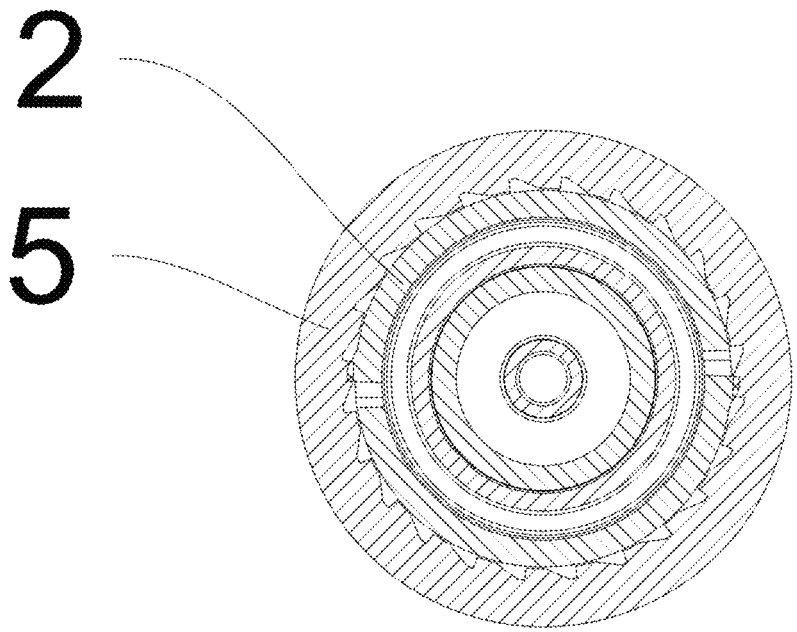
FIG. 5 is a sectional view along A-A shown in FIG. 4.
Figure 10:
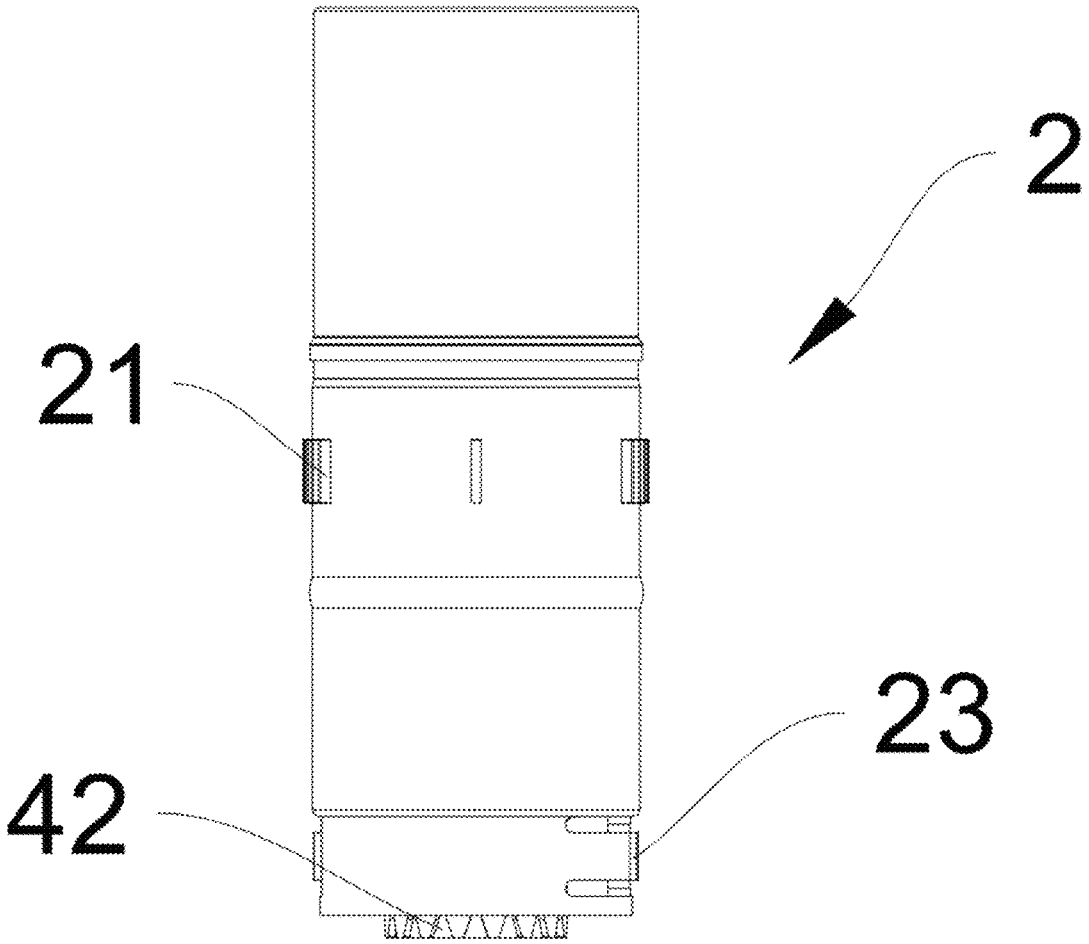
FIG. 10 is a front view of an inner bottle according to the present disclosure.

Referring to FIG. 3, FIG. 9 and FIG. 10, in the embodiment, optionally, a plurality of first rotation stop strips 21 are provided at a middle of an outer wall of the inner bottle 2. A circle of first convex strip 62 capable of cooperating with the first rotation stop strips 21 is provided on an inner wall of the inner lid 6. By clamping the first convex strip 62 into a gap between two first rotation stop strips 21, the inner lid 6 and the inner bottle 2 are circumferentially fixed.

Figure 11:
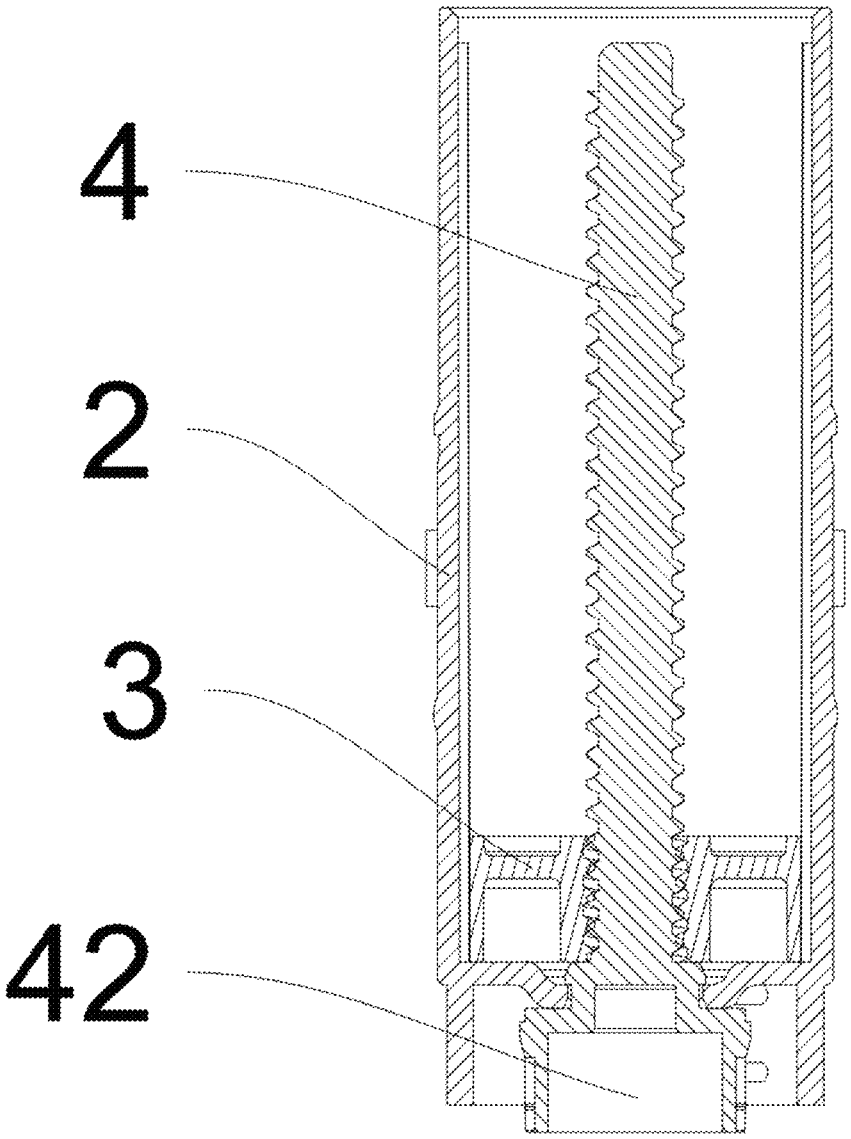
FIG. 11 is a sectional view after an inner bottle, a stopper, and a threaded rod are assembled according to the present disclosure.
Figure 12:
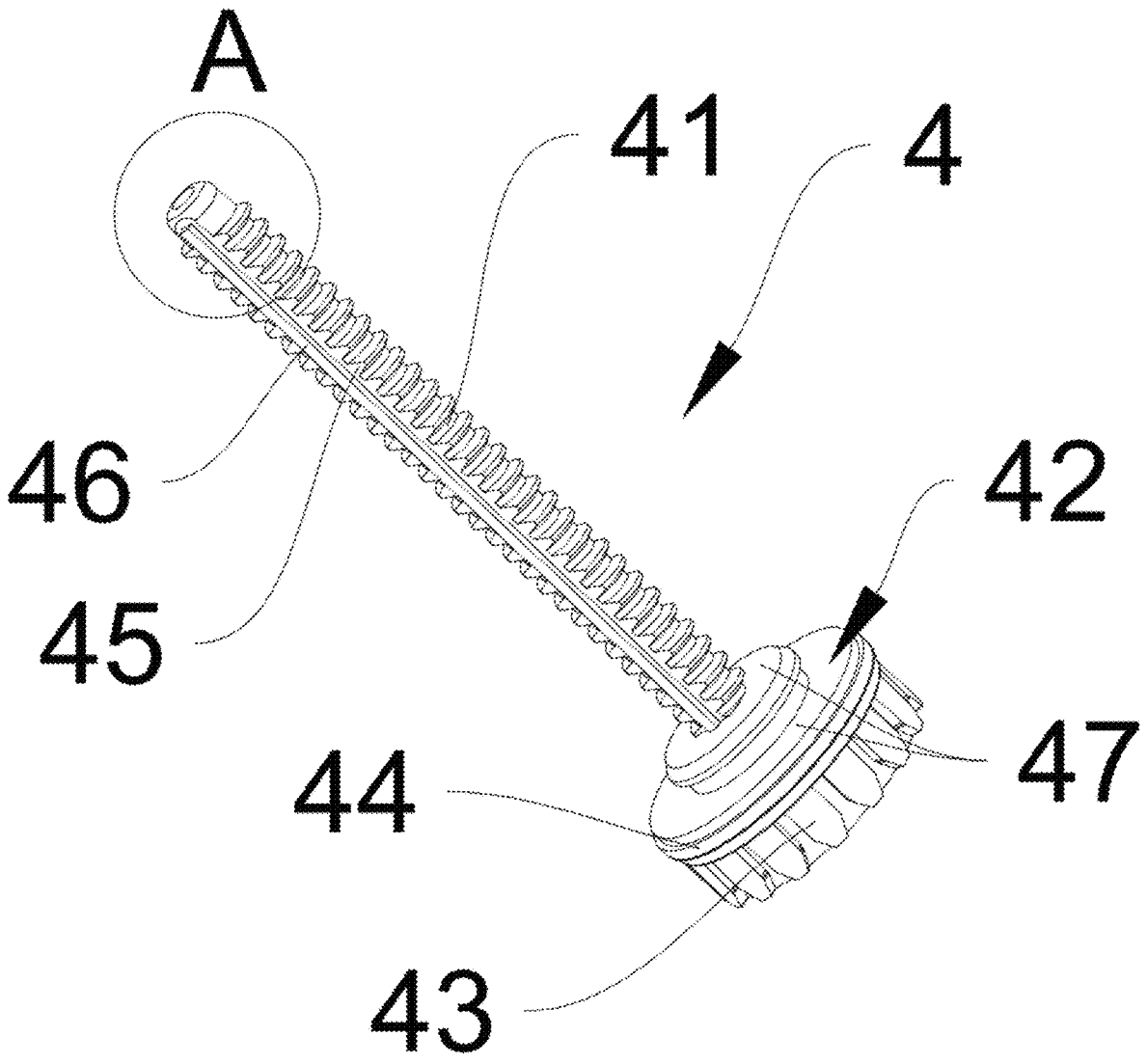
FIG. 12 is a perspective view of a threaded rod according to the present disclosure.
Figure 13:
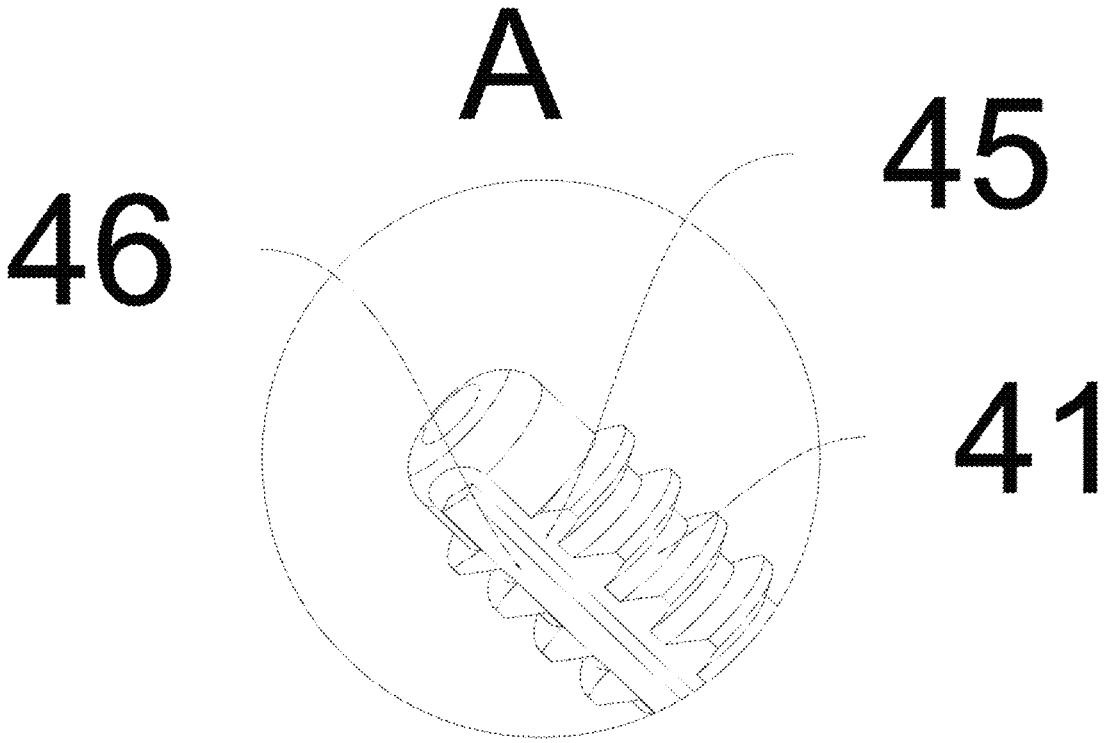
FIG. 13 is a partially enlarged view of A shown in FIG. 12.

Referring to FIG. 11 and FIG. 12, in the embodiment, optionally, the threaded rod 4 includes rod portion 41. The rod portion 41 extends along a radial direction of the rod portion to form base 42 having two steps 47. The rod portion 41 cooperates with the stopper 3. When the pedestal 5 is rotated, the rod portion 41 drives the stopper 3 to move up. The base 42 is located in the pedestal 5. At least two second rotation stop strips 43 are circumferentially provided on a sidewall of the base 42. An inner wall of a bottom of the pedestal 5 protrudes inward along a radial direction of the pedestal to form at least one second convex strip 52. The second convex strip 52 is located between two adjacent ones of the second rotation stop strips 43, thereby circumferentially fixing the threaded rod 4 and the pedestal 5. In the embodiment, there are four second convex strips 52. The four second convex strips 52 are equidistantly distributed on the inner wall of the bottom of the pedestal 5. In some optional embodiments, there may also be three, five or six second convex strips 52. In the embodiment, an end of each of the second rotation stop strips 43 close to a bottom of the base 42 is chamfered, so as to clamp the second convex strip 52 into a gap between two adjacent second rotation stop strips 43, and facilitate assembly.

In the embodiment, optionally, a circle of fixing hook 44 is further provided on the sidewall of the base 42. Fixing groove 53 capable of cooperating with the fixing hook 44 is formed in an inner wall of the pedestal 5, so as to improve the firmness of fixation between the base 42 and the pedestal 5, and prevent the base 42 from accidentally separating from the pedestal 5 in use.

Figure 14:
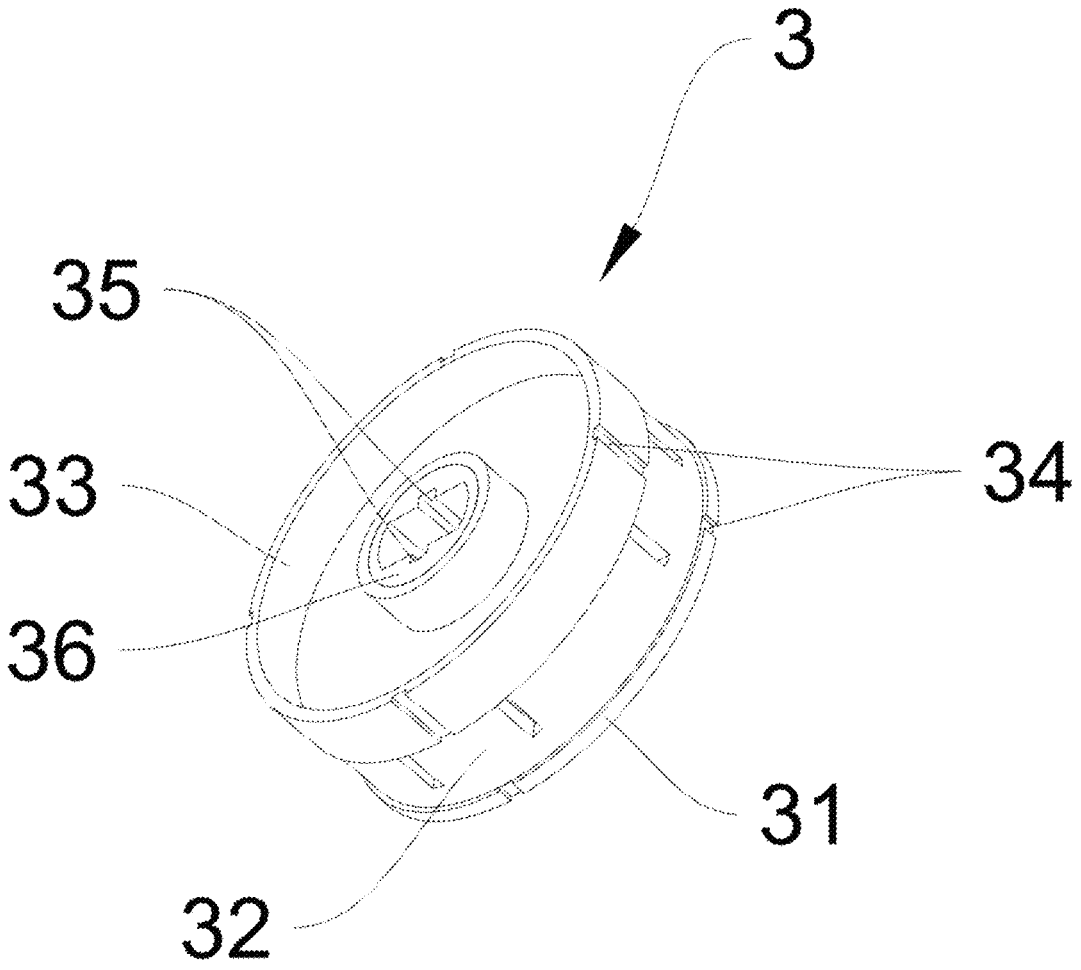
FIG. 14 is a perspective view of a stopper according to the present disclosure.

Referring to FIG. 9, FIG. 11 and FIG. 14, in the embodiment, optionally, an outer wall of the stopper 3 is tightly attached to an inner wall of the inner bottle 2. A plurality of third rotation stop strips 24 are provided on the inner wall of the inner bottle 2. Groove 34 capable of cooperating with the third rotation stop strips 24 is formed in the outer wall of the stopper 3. By clamping the third rotation stop strip 24 into the groove 34, the stopper 3 and the inner bottle 2 are circumferentially fixed.

Figure 15:
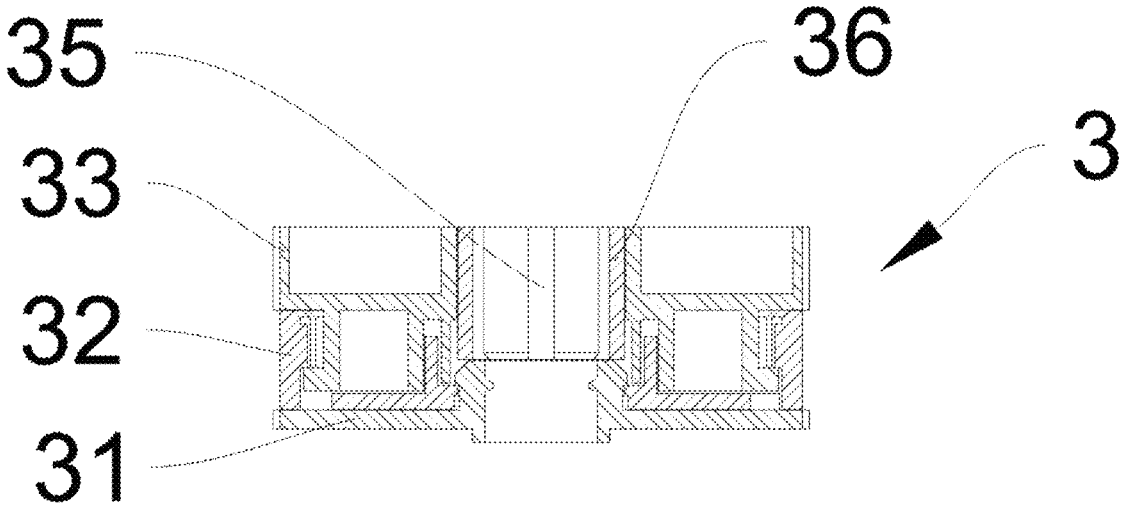
FIG. 15 is a sectional view of a stopper according to the present disclosure.
Figure 16:
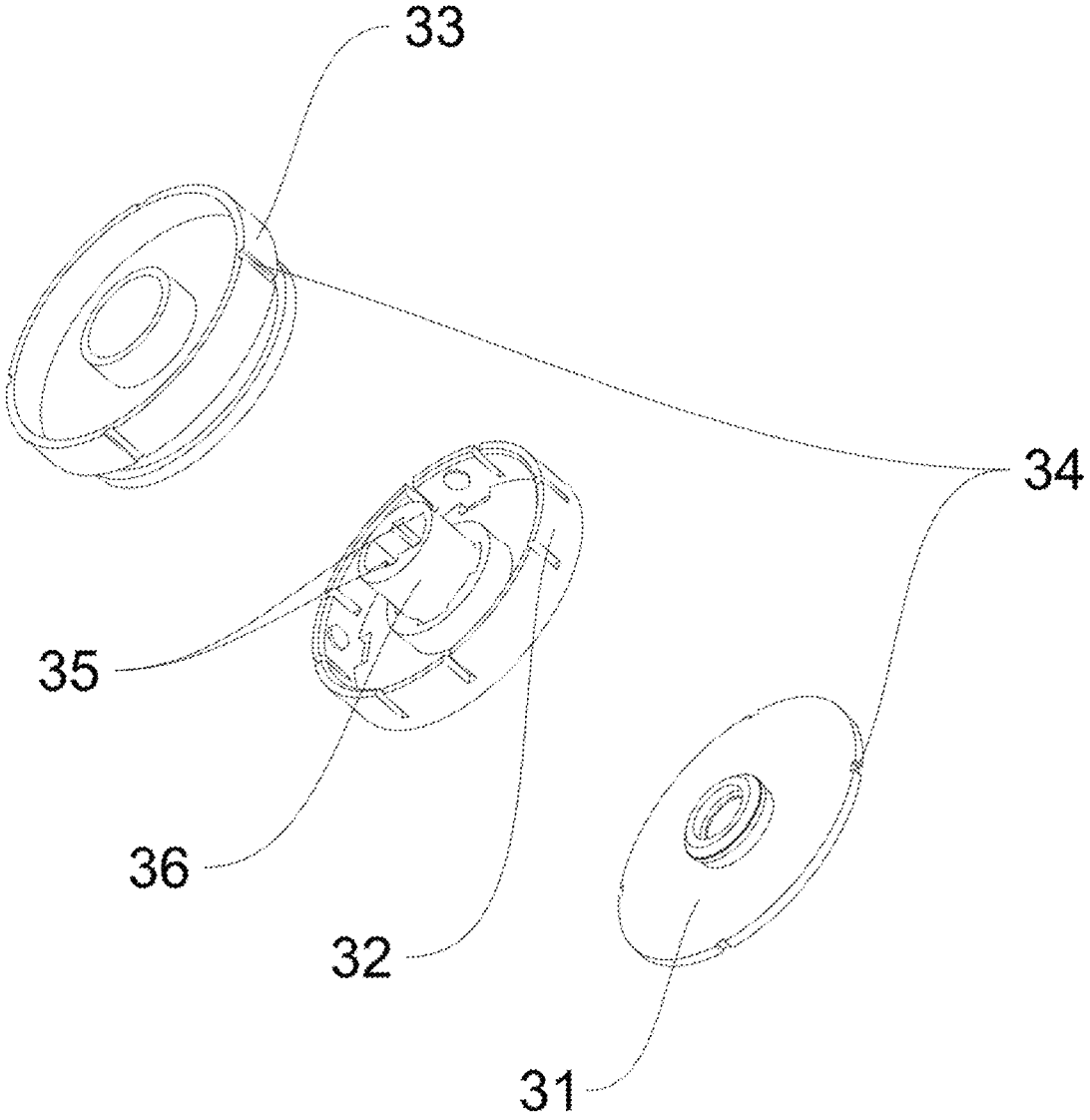
FIG. 16 is a perspective exploded view of a stopper according to the present disclosure.

Referring to FIGS. 14-16, in the embodiment, optionally, the stopper 3 includes nut 31, inner ring 32, and carrier 33. The nut 31 and the carrier 33 are respectively buckled at two sides of the inner ring 32. A threaded hole is formed in a middle of the nut 31. Fixed seat 36 is provided convexly at a middle of the inner ring 32. A second through hole for allowing the threaded rod 4 to penetrate is formed in a middle of the fixed seat 36. A third through hole for allowing the fixed seat 36 to penetrate is formed in a middle of the carrier 33. The paste 7 is provided at a top of the carrier 33. The threaded rod 4 penetrates through the paste 7. The threaded rod 4 can be threadedly connected to the threaded hole. The threaded rod 4 can penetrate through the second through hole, and then penetrate through the paste 7.

In the embodiment, optionally, two opposite planes 45 are provided on the threaded rod 4. Third convex strips 46 extending along an axial direction of the threaded rod 4 are provided oppositely on the two planes 45. Avoidance grooves 35 for allowing two third convex strips 46 to pass through are respectively formed at two sides of the second through hole. The nut 31 is relatively static with the inner ring 32 and the carrier 33. Through mutual cooperation between the avoidance groove 35 and the third convex strip 46, the stopper 3 can move more stably, and the stopper 3 does not incline in movement.

In the embodiment, optionally, a circle of positioning protrusion 22 is provided on an outer wall of the inner bottle 2. A circle of positioning groove capable of rotatably cooperating with the positioning protrusion 22 is formed in an inner wall of the pedestal 5.

The paste container in the embodiment is used conveniently, and can accurately control the extended length of the paste.

What is claimed is:

1. A paste container, comprising a lid, an inner bottle, a stopper, a threaded rod, a pedestal, and an inner lid fixed at a top of the inner bottle, wherein a bottom of the lid is detachably connected to the pedestal;

the stopper is provided in the inner bottle and circumferentially fixed with the inner bottle;

the threaded rod comprises a bottom circumferentially fixed with the pedestal, and the bottom of the threaded rod extends into a first through hole at a bottom of the inner bottle and is threadedly connected to the stopper;

the pedestal is sleeved on the bottom of the inner bottle and rotatably connected to the inner bottle;

the pedestal is allowed for rotating unidirectionally relative to the inner bottle in a step-by-step manner;

a top of the stopper is allowed for supporting a paste; and the threaded rod rotates with rotation of the pedestal and drives the stopper to move toward the top of the inner bottle, wherein the paste is squeezed out of a discharge hole at a top of the inner lid;

wherein a circle of ratchets are provided on an inner wall of the pedestal at intervals; an elastic piece is provided at the bottom of the inner bottle; and by rotating the pedestal, an end of the elastic piece is allowed for being unidirectionally clamped into gaps between the ratchets in sequence.

2. The paste container according to claim 1, wherein the circle of ratchets are equidistantly distributed on the inner wall of the pedestal.

3. The paste container according to claim 1, wherein the stopper comprises a nut, an inner ring, and a carrier;

the nut and the carrier are respectively buckled at two sides of the inner ring;

a threaded hole is formed in a middle of the nut;

a fixed seat is provided convexly at a middle of the inner ring;

a second through hole for allowing the threaded rod to penetrate is formed in a middle of the fixed seat;

a third through hole for allowing the fixed seat to penetrate is formed in a middle of the carrier;

the paste is provided at a top of the carrier; and the threaded rod penetrates through the paste.

4. The paste container according to claim 3, wherein two opposite planes are provided on the threaded rod; two third convex strips extending along an axial direction of the threaded rod are provided oppositely on the two planes; avoidance grooves for allowing the two third convex strips to pass through are respectively formed at two sides of the second through hole; and the nut is relatively static with the inner ring and the carrier.

5. The paste container according to claim 1, wherein a circle of positioning protrusion is provided on an outer wall of the inner bottle; and a circle of positioning groove allowed for rotatably cooperating with the circle of positioning protrusion is formed in an inner wall of the pedestal.

6. A paste container, comprising a lid, an inner bottle, a stopper, a threaded rod, a pedestal, and an inner lid fixed at a top of the inner bottle, wherein a bottom of the lid is detachably connected to the pedestal;

the stopper is provided in the inner bottle and circumferentially fixed with the inner bottle;

the threaded rod comprises a bottom circumferentially fixed with the pedestal, and the bottom of the threaded rod extends into a first through hole at a bottom of the inner bottle and is threadedly connected to the stopper;

the pedestal is sleeved on the bottom of the inner bottle and rotatably connected to the inner bottle;

the pedestal is allowed for rotating unidirectionally relative to the inner bottle in a step-by-step manner;

a top of the stopper is allowed for supporting a paste; and the threaded rod rotates with rotation of the pedestal and drives the stopper to move toward the top of the inner bottle, wherein the paste is squeezed out of a discharge hole at a top of the inner lid;

wherein a plurality of first rotation stop strips are provided at a middle of an outer wall of the inner bottle; and a circle of first convex strip allowed for cooperating with the plurality of first rotation stop strips is provided on an inner wall of the inner lid.

7. The paste container according to claim 6, wherein the threaded rod comprises a rod portion;

the rod portion extends along a radial direction of the rod portion to form a base having two steps;

the rod portion cooperates with the stopper;

the base of the threaded rod is located in the pedestal;

at least two second rotation stop strips are circumferentially provided on a sidewall of the base;

an inner wall of a bottom of the pedestal protrudes inward along a radial direction of the pedestal to form at least one second convex strip; and the at least one second convex strip is located between two adjacent ones of the at least two second rotation stop strips.

8. The paste container according to claim 7, wherein a circle of fixing hook is further provided on the sidewall of the base; and a fixing groove allowed for cooperating with the circle of fixing hook is formed in an inner wall of the pedestal.

9. A paste container, comprising a lid, an inner bottle, a stopper, a threaded rod, a pedestal, and an inner lid fixed at a top of the inner bottle, wherein a bottom of the lid is detachably connected to the pedestal;

the stopper is provided in the inner bottle and circumferentially fixed with the inner bottle;

the threaded rod comprises a bottom circumferentially fixed with the pedestal, and the bottom of the threaded rod extends into a first through hole at a bottom of the inner bottle and is threadedly connected to the stopper;

the pedestal is sleeved on the bottom of the inner bottle and rotatably connected to the inner bottle;

the pedestal is allowed for rotating unidirectionally relative to the inner bottle in a step-by-step manner;

a top of the stopper is allowed for supporting a paste; and the threaded rod rotates with rotation of the pedestal and drives the stopper to move toward the top of the inner bottle, wherein the paste is squeezed out of a discharge hole at a top of the inner lid;

wherein an outer wall of the stopper is tightly attached to an inner wall of the inner bottle; a plurality of third rotation stop strips are provided on the inner wall of the inner bottle; and a groove allowed for cooperating with the plurality of third rotation stop strips is formed in the outer wall of the stopper.

* * * * *